US011696642B2

(12) United States Patent
Celik et al.

(10) Patent No.: US 11,696,642 B2
(45) Date of Patent: Jul. 11, 2023

(54) SHELF SUPPORT BRACKET SYSTEM FOR GLASS REFRIGERATOR SHELF AND REFRIGERATOR SHELF ASSEMBLY USING SAME

(71) Applicants: BSH Home Appliances Corporation, Irvine, CA (US); BSH Hausgeräte GmbH, Munich (DE)

(72) Inventors: Cetin Abdullah Celik, Knoxville, TN (US); Felix Hänßler, Langenau (DE); Samuel Harward, Knoxville, TN (US); Cemalettin Hasturk, Farragut, TN (US)

(73) Assignees: BSH Hope Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 186 days.

(21) Appl. No.: 16/810,903

(22) Filed: Mar. 6, 2020

(65) Prior Publication Data

US 2021/0274935 A1 Sep. 9, 2021

(51) Int. Cl.

| | |
|---|---|
| ***A47B 96/02*** | (2006.01) |
| ***F25D 25/02*** | (2006.01) |
| ***A47B 57/34*** | (2006.01) |
| ***A47B 96/06*** | (2006.01) |

(52) U.S. Cl.

CPC ..... *A47B 96/028* (2013.01); *A47B 57/34* (2013.01); *A47B 96/062* (2013.01); *F25D 25/02* (2013.01); *F25D 2325/022* (2013.01)

(58) Field of Classification Search

CPC ..... A47B 96/028; A47B 57/34; A47B 96/062; A47B 96/061; A47B 57/42; A47B 96/025; A47B 96/027; F25D 25/02; F25D 2325/022; F25D 25/024

See application file for complete search history.

(56) References Cited

U.S. PATENT DOCUMENTS

| | | | | | |
|---|---|---|---|---|---|
| 2,236,044 | A * | 3/1941 | Vanderveld | A47B 57/482 | 248/243 |
| 3,604,670 | A * | 9/1971 | Reeves | A47B 96/061 | 248/250 |
| 3,606,229 | A * | 9/1971 | Wall | A47B 96/061 | 248/235 |
| 3,707,273 | A * | 12/1972 | Bortz | A47B 96/061 | 248/235 |
| 3,862,784 | A * | 1/1975 | Heinrich | A47F 3/12 | 108/108 |
| 4,431,155 | A * | 2/1984 | Engel | A47B 96/061 | 108/108 |
| 4,854,535 | A * | 8/1989 | Winter | A47B 57/42 | 211/208 |

(Continued)

*Primary Examiner* — Hiwot E Tefera

(74) *Attorney, Agent, or Firm* — Michael E. Tschupp; Andre Pallapies; Brandon G. Braun

(57) ABSTRACT

A shelf support bracket system for a transparent refrigerator shelf of a refrigerator, including: an unfinished metal, load-bearing support bracket having mounting hooks at one end for mounting to an inside wall of the refrigerator; and a decorative cover sleeve slidably disposed over the unfinished metal, load-bearing support bracket so as to cover a substantial portion thereof. The decorative cover sleeve has an upper surface serving as an attachment surface that is configured to receive the transparent refrigerator shelf.

17 Claims, 6 Drawing Sheets

(56) References Cited

U.S. PATENT DOCUMENTS

| | | | | |
|---|---|---|---|---|
| 5,205,524 | A * | 4/1993 | Cohen | F16B 7/14 248/222.51 |
| 5,297,486 | A * | 3/1994 | Herrmann | A47B 96/028 108/108 |
| 6,786,562 | B2 | 9/2004 | Obrock et al. | |
| 6,811,045 | B1 * | 11/2004 | Masker | F25D 25/02 211/153 |
| D568,344 | S | 5/2008 | Baacke et al. | |
| 7,575,212 | B1 * | 8/2009 | Langelius | A47B 57/42 211/192 |
| 8,282,178 | B2 | 10/2012 | Bradley et al. | |
| 8,622,494 | B2 | 1/2014 | Picken et al. | |
| 8,651,600 | B2 | 2/2014 | Cheong et al. | |
| 8,899,704 | B2 | 12/2014 | Bienick | |
| 9,207,012 | B2 | 12/2015 | Driver et al. | |
| 9,456,692 | B2 * | 10/2016 | Tibbe | A47B 96/061 |
| 9,504,324 | B2 | 11/2016 | McMillin et al. | |
| 10,130,176 | B2 | 11/2018 | Driver et al. | |
| D855,352 | S | 8/2019 | Nilssen et al. | |
| 10,670,327 | B1 * | 6/2020 | Haenssler | F25D 23/067 |
| 10,935,305 | B1 * | 3/2021 | Bassler | F25D 25/024 |
| 2002/0190620 | A1 * | 12/2002 | Vardon | A47B 96/027 312/408 |
| 2011/0089800 | A1 * | 4/2011 | Nash | A47B 96/062 312/404 |
| 2015/0023000 | A1 | 1/2015 | Kendall et al. | |
| 2015/0226474 | A1 | 8/2015 | Choi et al. | |
| 2016/0100685 | A1 * | 4/2016 | Tibbe | A47B 96/061 248/220.22 |
| 2019/0195552 | A1 * | 6/2019 | Roesch | F25D 25/027 |
| 2019/0380492 | A1 * | 12/2019 | Heap | A47B 57/42 |
| 2020/0080768 | A1 * | 3/2020 | Stewart | F25D 25/02 |
| 2021/0274933 | A1 * | 9/2021 | Nilsson | A47B 57/42 |

* cited by examiner

SHELF SUPPORT BRACKET SYSTEM FOR GLASS REFRIGERATOR SHELF AND REFRIGERATOR SHELF ASSEMBLY USING SAME

FIELD OF THE INVENTION

The present disclosure relates generally to a refrigerator appliance and to a refrigerator shelf assembly. More particularly, the present disclosure relates to a shelf support bracket system for a glass refrigerator shelf and to a refrigerator shelf assembly using the shelf support bracket system.

BACKGROUND OF THE INVENTION

In general, glass shelves for home or domestic refrigerator appliances are an important feature for consumers as the glass shelves need to be capable of supporting heavy loads, while at the same time be aesthetically pleasing to the eye. In other words, the supports for such glass shelves must have a strong attachment to ensure consumer safety and must not fall from their supports or drop their load. On the other hand, bulky and unattractive shelf support assemblies are undesirable by customers that appreciate clean and simple designs.

Some of the existing solutions for supporting glass shelves include shelf supports formed in the inner liner of the refrigerator, inexpensive or common looking supports that are hidden by paint masking formed on the glass shelf, inexpensive or common looking supports that are hidden by a frame around the glass shelf, revealed shelf supports that are bulky and/or unattractive and expensive to manufacture, or revealed shelf supports that are formed of stamped steel. All of these solutions are unacceptable as they can give a consumer perception of cheapness. Moreover, revealed supports made with aluminum castings which attach to structural steel members have been used, but the back side of each casting must face the refrigerator walls so that the customer does not see the rough back surface. This requires that casting tools must be created for left and right parts and thus is unduly expensive.

SUMMARY OF THE INVENTION

The present inventors have observed that it is often the case that a minimalist design language is desired by customers. In such a design, glass shelves should be frameless and should look as though they rest effortlessly on their supports. Because a frameless glass shelf does not hide the supports at all, the supports should have a premium look and feel. In other words, no common or "cheap" materials should be visible when the customer or user sees the supports or support brackets through the glass shelf.

An apparatus consistent with the present disclosure is directed to providing a shelf support bracket system for a glass refrigerator shelf and to a refrigerator shelf assembly using the shelf support bracket system.

An apparatus consistent with the present disclosure is directed to providing a shelf support bracket system which comprises a sturdy but inexpensive stamped metal support and which in turn slides into an attractive extruded profile or sleeve.

Consistent with the present invention, the inexpensive stamped metal support can be made of steel, whereas the attractive extruded profile or sleeve can be made of aluminum, painted acrylonitrile butadiene styrene (ABS), or other premium looking material that is aesthetically pleasing to the eye of the consumer.

According to one aspect, the present disclosure provides a shelf support bracket system for a transparent refrigerator shelf of a refrigerator, comprising: an unfinished metal, load-bearing support bracket having mounting hooks at one end for mounting to an inside wall of the refrigerator; and a decorative cover sleeve slidably disposed over the unfinished metal, load-bearing support bracket so as to cover a substantial portion thereof, the decorative cover sleeve having an upper surface serving as an attachment surface that is configured to receive the transparent refrigerator shelf.

According to another aspect, the unfinished metal, load-bearing support bracket is made of stamped steel.

According to another aspect, the decorative cover sleeve comprises an extruded profile.

According to another aspect, the extruded profile is made of one of aluminum or painted acrylonitrile butadiene styrene (ABS).

According to another aspect, the decorative cover sleeve is made of one of aluminum, steel, painted steel, physical vapor deposition (PVD) coated steel, powder coated steel, stainless steel, zamak, plastic, or fiber resin.

According to another aspect, the decorative cover sleeve has an end cap configured to engage an end portion of the unfinished metal, load-bearing support bracket.

According to another aspect, the decorative cover sleeve extends over the unfinished metal, load-bearing support bracket back to a rear portion of the unfinished metal, load-bearing support bracket.

According to another aspect, the present disclosure provides a refrigerator shelf assembly for a refrigerator, comprising: a glass refrigerator shelf; a pair of shelf support bracket systems, wherein each of the pair of shelf support bracket systems comprises: an unfinished metal, load-bearing support bracket having mounting hooks at one end for mounting to an inside wall of the refrigerator; and a decorative cover sleeve slidably disposed over the unfinished metal, load-bearing support bracket so as to cover a substantial portion thereof, the decorative cover sleeve having an upper surface serving as an attachment surface that receives the glass refrigerator shelf; and an adhesive disposed on the attachment surface of each of the pair of shelf support bracket systems and which adheres the glass refrigerator shelf to the pair of shelf support bracket systems.

According to another aspect, the unfinished metal, load-bearing support bracket is made of stamped steel.

According to another aspect, the decorative cover sleeve comprises an extruded profile.

According to another aspect, the extruded profile is made of one of aluminum or painted acrylonitrile butadiene styrene (ABS).

According to another aspect, the decorative cover sleeve is made of one of aluminum or painted ABS.

According to another aspect, the decorative cover sleeve has an end cap configured to engage an end portion of the unfinished metal, load-bearing support bracket.

According to another aspect, the decorative cover sleeve extends extends over the unfinished metal, load-bearing support bracket back to a rear portion of the unfinished metal, load-bearing support bracket.

According to another aspect, the adhesive comprises one of a clear acrylic tape, a clear ultraviolet (UV)-cure tape, an adhesive tape that is not clear, a liquid glue, or a two-part epoxy.

According to another aspect, the present disclosure provides a refrigerator having a casing defining an inside wall having a plurality of vertical tracks with openings therein, comprising: a glass refrigerator shelf; a pair of shelf support bracket systems, wherein each of the pair of shelf support bracket systems comprises: an unfinished metal, load-bearing support bracket having mounting hooks at one end which are mounted to the openings of a corresponding one of the vertical tracks on the inside wall of the refrigerator; and a decorative cover sleeve slidably disposed over the unfinished metal, load-bearing support bracket so as to cover a substantial portion thereof, the decorative cover sleeve having an upper surface serving as an attachment surface that receives the glass refrigerator shelf; and an adhesive disposed on the attachment surface of each of the pair of shelf support bracket systems and which adheres the glass refrigerator shelf to the pair of shelf support bracket systems.

According to another aspect, the unfinished metal, load-bearing support bracket is made of stamped steel.

According to another aspect, the decorative cover sleeve comprises an extruded profile.

According to another aspect, the extruded profile is made of one of aluminum or painted acrylonitrile butadiene styrene (ABS).

According to another aspect, the decorative cover sleeve has an end cap configured to engage an end portion of the unfinished metal, load-bearing support bracket.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 8A:
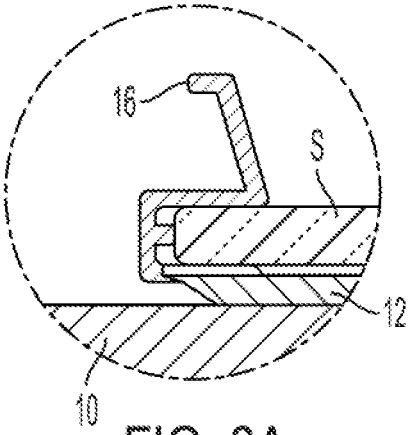
Figure 8B:
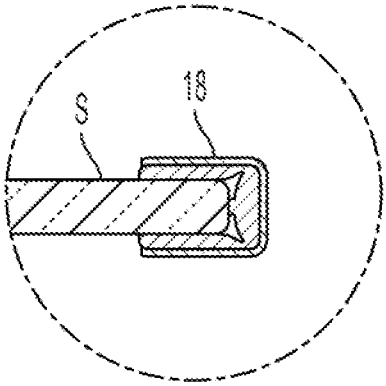
Figure 8C:
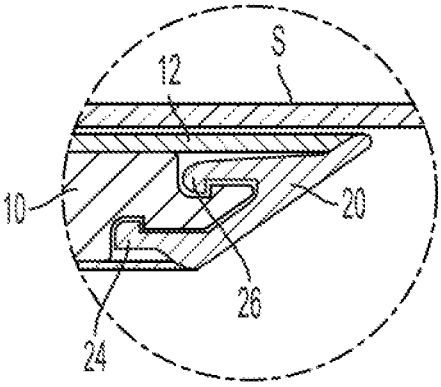
Figure 9A:
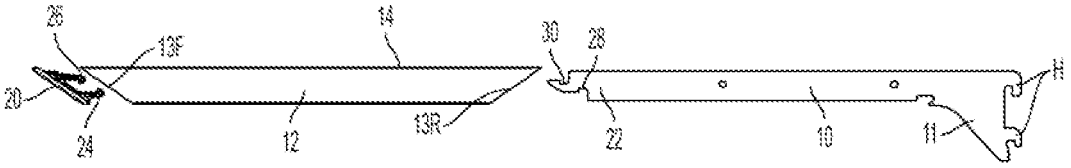
Figure 9B:
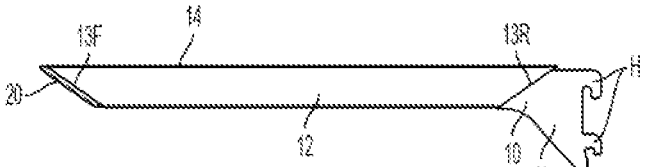
Figure 9C:
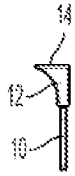
Figure 9D:
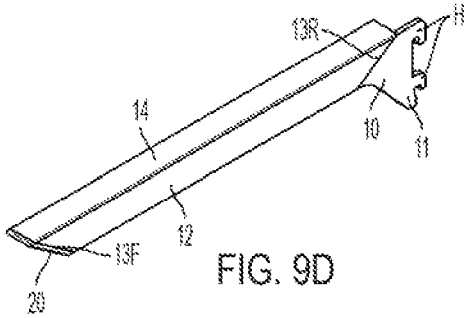

FIGS. 8A, 8B, and 8C are partial sectional views of a rear portion of one shelf support bracket system, a front of the glass shelf, and a front portion of one shelf support bracket system, respectively, according to an exemplary embodiment consistent with the present disclosure; and FIGS. 9A, 9B, 9C, and 9D are an exploded side view, a side view, a front view, and a perspective view, respectively, of one of the shelf support bracket systems according to an exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

As used herein, the terms "shelf support bracket system" or "shelf support bracket" refer to structural elements used to support the transparent shelf such as a glass shelf or glass shelf panel (also sometimes referred to as a glass refrigerator shelf). As will be discussed in more detail below, the shelf support bracket system or shelf support bracket includes hooks at the rear for connection to and adjustment along vertical tracks formed by openings such as slots or holes in a wall (e.g., a rear wall) of the refrigeration compartment.

Figure 1:
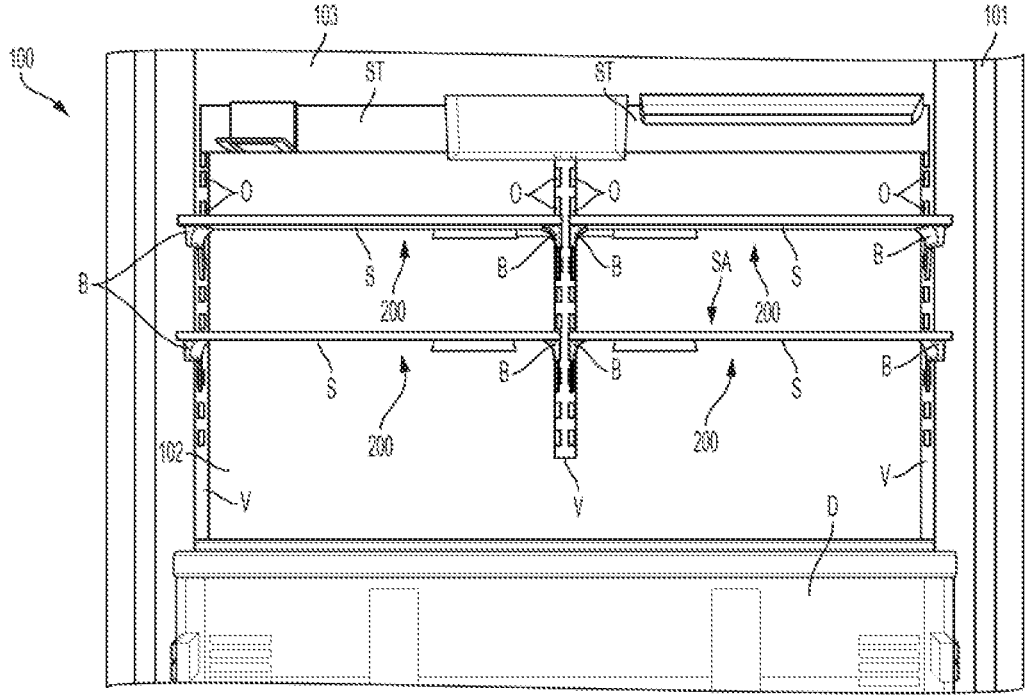
FIG. 1 is a fragmentary, front perspective view showing the inside of a refrigerator appliance having a plurality of refrigerator shelf assemblies including shelf support bracket systems for a glass refrigerator shelf located in a fresh food compartment according to an exemplary embodiment consistent with the present disclosure.

FIG. 1 is a fragmentary, front perspective view showing the inside of a refrigerator appliance 100 having a plurality of refrigerator shelf assemblies 200 including shelf support bracket systems B located in a fresh food compartment 102 according to an exemplary embodiment consistent with the present disclosure. FIG. 1 illustrates the refrigerator appliance 100 with the door(s) removed to reveal the fresh food compartment (also referred to as a refrigeration compartment) 102 according to an exemplary embodiment consistent with the present disclosure. The refrigerator appliance 100 can be, but is not limited to, a French door-bottom mount (FDBM) style refrigerator. More specifically, the refrigerator appliance 100 includes an insulated body 101 having the fresh food compartment 102 located above and being closed by one or two doors (not shown), a freezer compartment (not shown—bottom mount style) covered by a freezer door (not shown) and located below the fresh compartment 102. The fresh food compartment 102 includes, for example, a number of glass shelves S (in this case half width shelves), an upper tray ST, food racks (not shown) such as in the doors, and a vegetable drawer D. As noted above, the glass shelves S are supported by shelf support bracket systems or shelf support brackets B that include hooks H (see FIGS. 2, 3A, 6, 7, 9A, 9B, and 9D) at the rear for engagement with/connection to and adjustment along vertical tracks V (in this case three vertical tracks V are shown) formed by separate metal strips having openings such as slots or holes O therein and arranged along a wall (e.g., a rear wall 103) of the refrigeration compartment 102. The fresh food or refrigeration compartment 102 is typically set in a range of 1° C. to 4° C., and the freezer compartment is typically set at −18° C. or colder.

Figure 2:
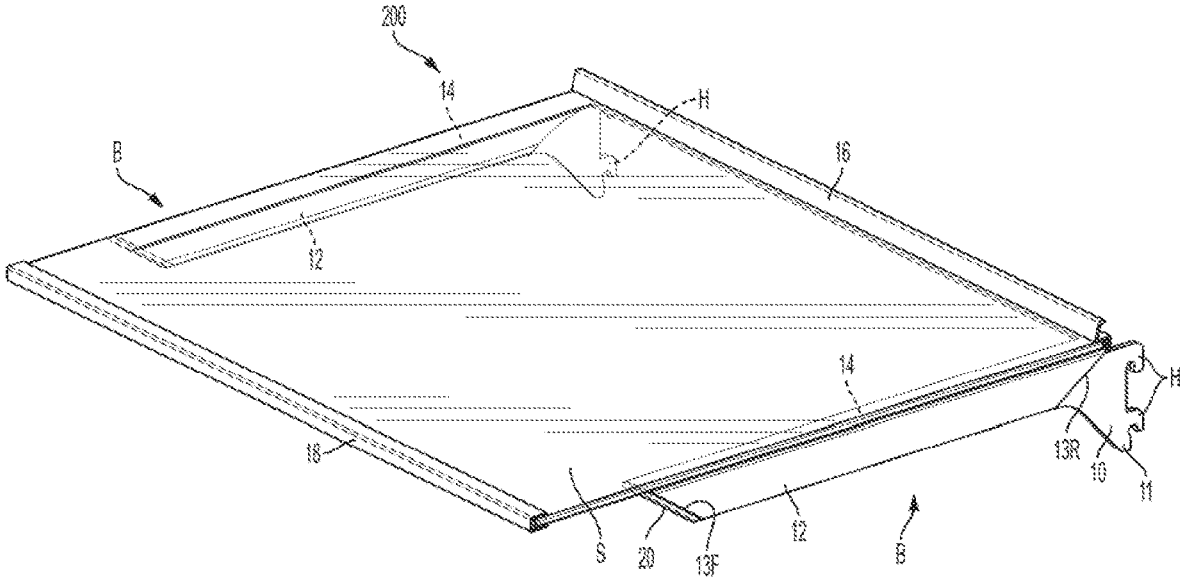
FIG. 2 is a top, right-front perspective view of a refrigerator shelf assembly using a pair of the shelf support bracket systems according to an exemplary embodiment consistent with the present disclosure.
Figure 3A:
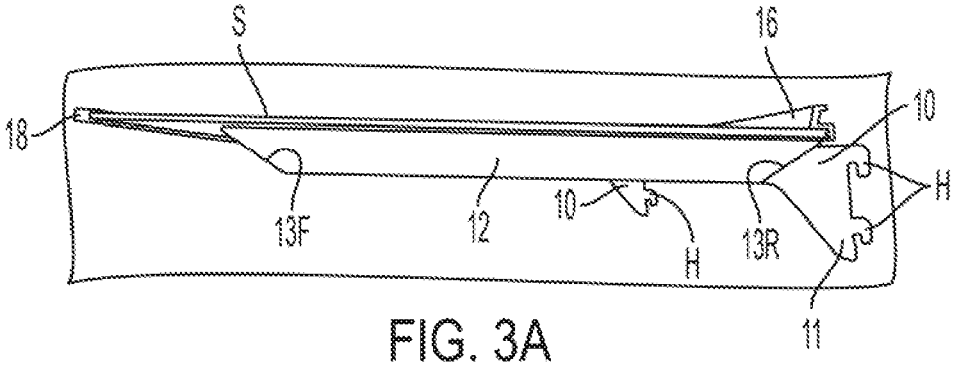
FIG. 3A is a right side perspective view of a refrigerator shelf assembly using a pair of the shelf support bracket systems according to an exemplary embodiment consistent with the present disclosure.
Figure 3B:
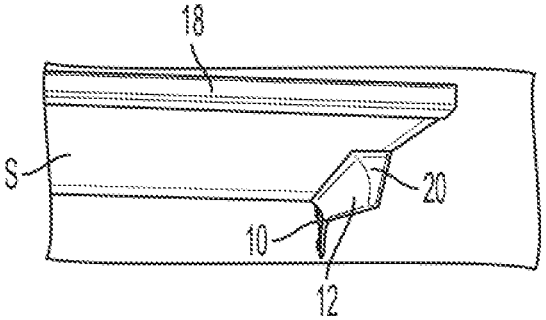
FIG. 3B is a partial front perspective view from below of one shelf support bracket system according to an exemplary embodiment consistent with the present disclosure.
Figure 3C:
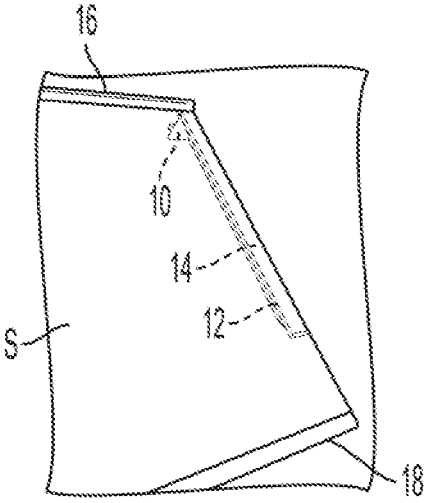
FIG. 3C is a partial top perspective view of one shelf support bracket system according to an exemplary embodiment consistent with the present disclosure.
Figure 4:
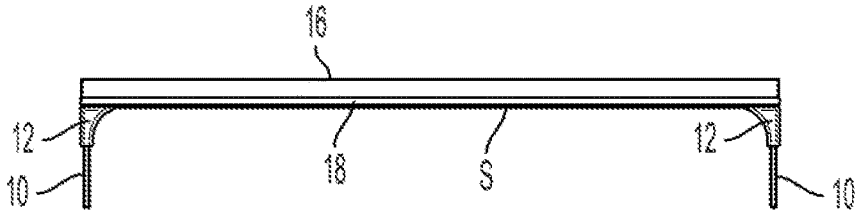
FIG. 4 is a front view of a refrigerator shelf assembly using a pair of the shelf support bracket systems according to an exemplary embodiment consistent with the present disclosure.

FIG. 2 is a top, right-front perspective view of one of the refrigerator shelf assemblies 200 per se of FIG. 1 using a pair of the shelf support bracket systems B at each side according to an exemplary embodiment consistent with the present disclosure. Moreover, FIGS. 3A-5A show various additional views of the refrigerator shelf assembly 200. In particular, the refrigerator shelf assembly 200 comprises a transparent shelf such as a glass shelf or glass shelf panel S and two shelf support bracket systems B respectively disposed at the right side and left side of the glass shelf panel S and which are configured to be supported by the hooks H located at the rear portion thereof and engaged with the openings O in the vertical tracks V in, for example, the rear wall 103 of the refrigerator compartment 102. The glass shelf S may be formed of, for example, transparent tempered glass. As will be discussed in more detail below, the glass shelf S is adhered to the top of each of the two shelf support bracket systems B by an adhesive. As will also be discussed in more detail below, each of the two shelf support bracket systems B comprises an unfinished metal, load-bearing support bracket 10 (also referred to as bracket 10) having the mounting hooks H at the rear end; and an aesthetically pleasing or decorative, hollow cover sleeve 12 (also referred to as cover sleeve 12) slidably disposed over the unfinished metal, load-bearing support bracket 10 so as to cover a substantial portion of the bracket 10. The decorative cover sleeve 12 has an upper surface serving as an attachment surface 14 that is configured to receive and mount the glass shelf S using the adhesive. The refrigerator shelf assembly 200 may also comprise a glass retention member 16 at the rear of the glass shelf panel S, and a front trim piece 18 fitted over the front of the glass shelf panel S and which also serves as a grip when changing a height of the refrigerator shelf assembly 200 along the vertical tracks V.

The unfinished metal, load-bearing support bracket 10 is a sturdy but inexpensive stamped metal preferably made of stamped steel. On the other hand, the decorative cover sleeve 12 may comprise an extruded profile that is preferably made of aluminum or painted acrylonitrile butadiene styrene (ABS). While aluminum and painted ABS are preferred, other materials are possible such as, but not limited to, steel (painted, physical vapor deposition (PVD) coated, or powder coated), stainless steel, zamak, or various types of plastic or fiber resin (with or without decorative coating).

As noted above, the decorative cover sleeve 12 covers a substantial portion of the bracket 10. In this case, a substantial portion of the bracket 10 means the decorative cover sleeve 12 extends over the unfinished metal, load-bearing support bracket 10 back to a rear portion of the bracket 10 to a location adjacent to or close to or near the mounting hooks H while leaving a vertical portion 11 of the bracket 10 slightly exposed as shown in FIGS. 2, 3A, 9B, and 9D. This exposed portion is at the rear portion of the bracket 10 and thus not visible to the consumer/user when the hooks H are mounted to the openings O in the vertical track V and in the normal course of use of the refrigerator appliance 100. The rear end portion 13R of the decorative cover sleeve 12 can have a chamfered or tapered look that matches the front end portion 13F of the decorative cover sleeve 12. As discussed in more detail below, the decorative cover sleeve 12 also has an end cap 20 configured to engage a front end portion 22 of the unfinished metal, load-bearing support bracket 10 (see FIG. 9A).

As also noted above and as best shown in FIG. 5B, the adhesive, such as but not limited to, a clear adhesive tape T is disposed on the attachment surface 14 on the upper surface of the decorative cover sleeve 12 of each of the pair of shelf support bracket systems B and serves to adhere the glass refrigerator shelf S to the pair of shelf support bracket systems B. The cover sleeve 12 has a wide top portion as shown in FIGS. 5A, 5B, 9C, and 9D in order to provide a large attachment surface 14. This attachment surface 14 is large enough that the clear adhesive tape T such as, for example, a clear acrylic tape or a clear UV-cure tape can be used instead of more expensive UV-cure glue. Thus, use of the clear adhesive tape T lowers the cost compared to using glues. The use of clear acrylic tape lowers an adhesion process time to 7 seconds of pressing and holding instead of 60 seconds of UV curing, as is required for UV-cure glue. While a clear acrylic tape or a clear UV-cure tape are preferred, other options are possible such as, but not limited to, adhesive tape that is not clear, liquid glue, or two-part epoxies.

Figure 5A:
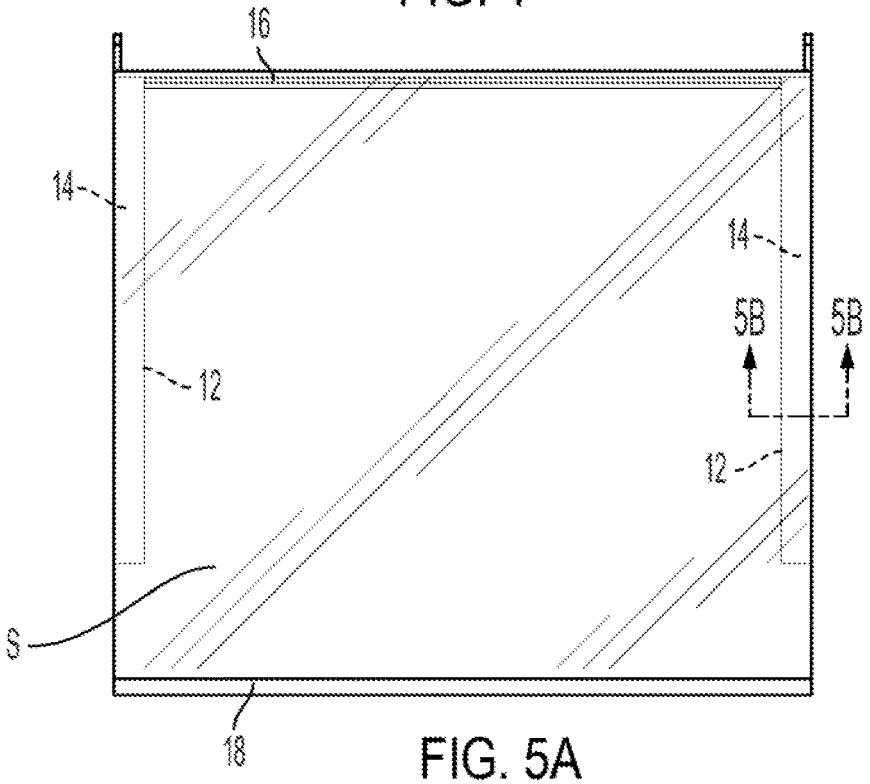
FIG. 5A is a top view of a refrigerator shelf assembly using a pair of the shelf support bracket systems according to an exemplary embodiment consistent with the present disclosure.
Figure 5B:
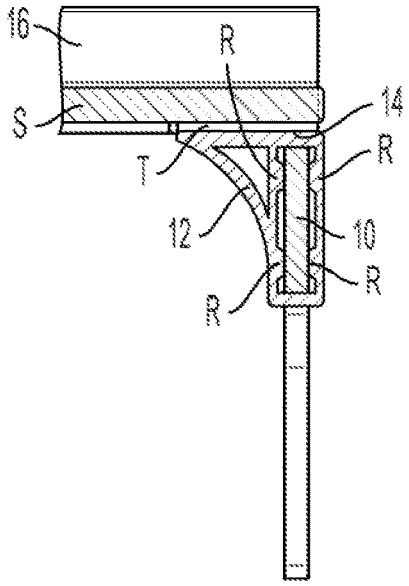
FIG. 5B is a partial sectional view through one shelf support bracket system along the lines 5B-5B in FIG. 5A according to an exemplary embodiment consistent with the present disclosure.
Figure 6:
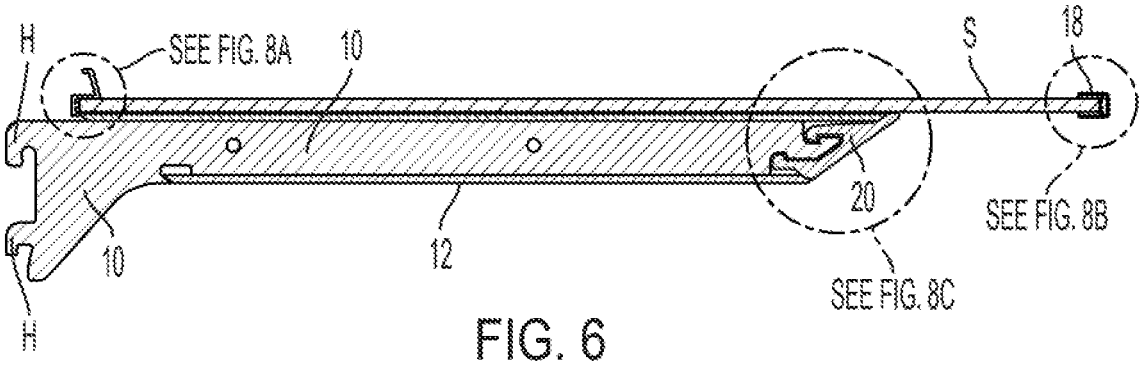
FIG. 6 is a longitudinal sectional view of one shelf support bracket system according to an exemplary embodiment consistent with the present disclosure.
Figure 7:
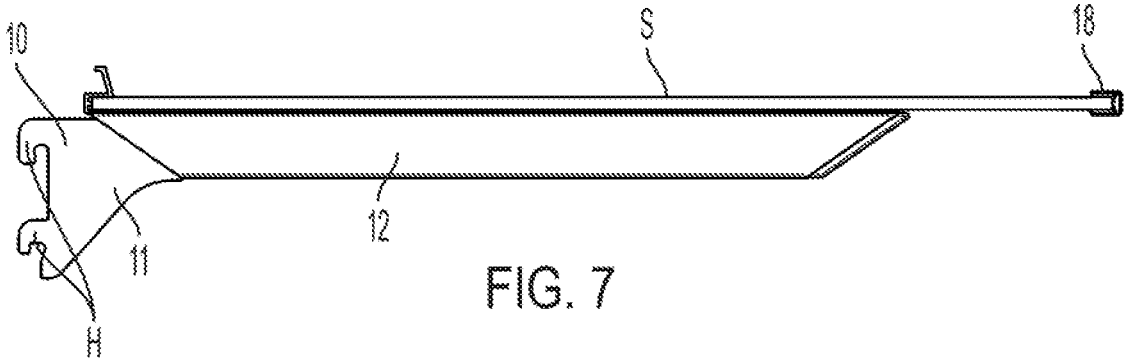
FIG. 7 is a side view of one shelf support bracket system according to an exemplary embodiment consistent with the present disclosure.

The decorative cover sleeves 12 can be designed to be symmetrical so that no distinct "left" and "right" tooling is required. Accordingly, left and right shelf support bracket systems B can be assembled from the same set of parts. As best shown in FIG. 5B, each of the decorative cover sleeves 12 includes a plurality of guide ribs R inside the hollow portion thereof in order to guide and support the decorative cover sleeve 12 as it slides over and is supported by the corresponding unfinished metal, load-bearing support bracket 10.

As noted above and as best shown in FIGS. 3B, 6, 8C, 9A, and 9D, each decorative cover sleeve 12 has a cosmetic end cap 20 which is inserted into the open front end portion 13F of the hollow cover sleeve 12 and configured to engage the front end portion 22 of the unfinished metal, load-bearing support bracket 10. The end cap 20 is configured to engage the front end portion 22 of the unfinished metal, load-bearing support bracket 10 by clipping into the bracket 10 via clips 24 and 26 which clip into recesses 28 and 30, respectively (see FIGS. 6, 8C, and 9A). This arrangement also keeps the decorative cover sleeves 12 (and the glass shelf S to which they are adhered) from sliding off of the brackets 10. The cosmetic end cap 20 may be formed of plastic such as ABS and be black in color or have an aluminum finish so as to look like the decorative cover sleeves 12.

The present disclosure thus provides a combination of premium appearance and attractive manufacturing cost which known solutions do not achieve.

The present disclosure has substantial opportunity for variation without departing from the spirit or scope of the present invention. For example, the aesthetically pleasing or decorative cover sleeve 12 could also be formed of brushed aluminum, brushed stainless steel, or brushed nickel to provide a premium look to the consumer. Also, the glass shelf or glass shelf panel S could be formed of Plexiglas® (acrylic sheet) or other premium transparent or clear plastic materials.

Those skilled in the art will recognize improvements and modifications to the exemplary embodiments of the present invention. All such improvements and modifications are considered within the scope of the concepts disclosed herein and the claims that follow.

What is claimed is:

1. A shelf support bracket system for a transparent refrigerator shelf of a refrigerator, comprising:

an unfinished metal, load-bearing support bracket having mounting hooks at one end for mounting to an inside wall of the refrigerator, the unfinished metal, load-bearing support bracket comprising a top surface and a bottom surface; and a decorative cover sleeve slidably disposed over the top surface and the bottom surface so as to cover a substantial portion of the unfinished metal, load-bearing support bracket, the decorative cover sleeve having an upper surface serving as an attachment surface that is configured to receive the transparent refrigerator shelf, the upper surface being substantially flat and without openings from a front end of the upper surface to a rear end of the upper surface, wherein the decorative cover sleeve further comprises an end cap with a plurality of clips configured to engage with a forward end of the unfinished metal, load-bearing support bracket to prevent the decorative cover sleeve from sliding off of the unfinished metal, load-bearing support bracket.

2. The shelf support bracket system of claim 1, wherein the unfinished metal, load-bearing support bracket is made of stamped steel, and wherein the decorative cover sleeve comprises an extruded profile.

3. The shelf support bracket system of claim 2, wherein the extruded profile is made of one of aluminum or painted acrylonitrile butadiene styrene (ABS).

4. The shelf support bracket system of claim 1, wherein the decorative cover sleeve is made of one of aluminum, steel, painted steel, physical vapor deposition (PVD) coated steel, powder coated steel, stainless steel, zamak, plastic, or fiber resin.

5. The shelf support bracket system of claim 1, wherein the decorative cover sleeve extends over the unfinished metal, load-bearing support bracket back to a rear portion of the unfinished metal, load-bearing support bracket.

6. The shelf support bracket system of claim 1, wherein the plurality of clips is positionable in a plurality of recesses positioned in the forward end of the unfinished metal, load-bearing support bracket.

7. A refrigerator shelf assembly for a refrigerator, comprising:

a glass refrigerator shelf;

a pair of shelf support bracket systems, wherein each of the pair of shelf support bracket systems comprises:

an unfinished metal, load-bearing support bracket having mounting hooks at one end for mounting to an inside wall of the refrigerator, the unfinished metal, load-bearing support bracket comprising a top surface and a bottom surface; and a decorative cover sleeve slidably disposed over the top surface and the bottom surface so as to cover a substantial portion of the unfinished metal, load-bearing support bracket, the decorative cover sleeve having an upper surface serving as an attachment surface that receives the glass refrigerator shelf, the upper surface being substantially flat and without openings from a front end of the upper surface to a rear end of the upper surface, wherein the decorative cover sleeve further comprises an end cap with a plurality of clips configured to engage with a forward end of the unfinished metal, load-bearing support bracket to prevent the decorative cover sleeve from sliding off of the unfinished metal, load-bearing support bracket; and an adhesive disposed on the attachment surface of each of the pair of shelf support bracket systems and which adheres the glass refrigerator shelf to the pair of shelf support bracket systems.

8. The refrigerator shelf assembly of claim 7, wherein the unfinished metal, load-bearing support bracket is made of stamped steel.

9. The refrigerator shelf assembly of claim 7, wherein the decorative cover sleeve comprises an extruded profile.

10. The refrigerator shelf assembly of claim 9, wherein the extruded profile is made of one of aluminum or painted acrylonitrile butadiene styrene (ABS).

11. The refrigerator shelf assembly of claim 7, wherein the decorative cover sleeve is made of one of aluminum or painted acrylonitrile butadiene styrene (ABS).

12. The refrigerator shelf assembly of claim 7, wherein the decorative cover sleeve extends over the unfinished metal, load-bearing support bracket back to a rear portion of the unfinished metal, load-bearing support bracket.

13. The refrigerator shelf assembly of claim 7, wherein the adhesive comprises one of a clear acrylic tape, a clear ultraviolet (UV)-cure tape, an adhesive tape that is not clear, a liquid glue, or a two-part epoxy.

14. A refrigerator having a casing defining an inside wall having a plurality of vertical tracks with openings therein, comprising:

a glass refrigerator shelf;

a pair of shelf support bracket systems, wherein each of the pair of shelf support bracket systems comprises:

an unfinished metal, load-bearing support bracket having mounting hooks at one end which are mounted to the openings of a corresponding one of the vertical tracks on the inside wall of the refrigerator, the unfinished metal, load-bearing support bracket comprising a top surface and a bottom surface; and a decorative cover sleeve slidably disposed over the top surface and the bottom surface so as to cover a substantial portion of the unfinished metal, load-bearing support bracket, the decorative cover sleeve having an upper surface serving as an attachment surface that receives the glass refrigerator shelf, the upper surface being substantially flat and without openings from a front end of the upper surface to a rear end of the upper surface, wherein the decorative cover sleeve further comprises an end cap with a plurality of clips configured to engage with a forward end of the unfinished metal, load-bearing support bracket to prevent the decorative cover sleeve from sliding off of the unfinished metal, load-bearing support bracket; and an adhesive disposed on the attachment surface of each of the pair of shelf support bracket systems and which adheres the glass refrigerator shelf to the pair of shelf support bracket systems.

15. The refrigerator of claim 14, wherein the unfinished metal, load-bearing support bracket is made of stamped steel.

16. The refrigerator of claim 14, wherein the decorative cover sleeve comprises an extruded profile.

17. The refrigerator of claim 16, wherein the extruded profile is made of one of aluminum or painted acrylonitrile butadiene styrene (ABS).

* * * * *